US005772501A

United States Patent [19]

Merry et al.

[11] Patent Number: 5,772,501

[45] Date of Patent: Jun. 30, 1998

[54] INDOOR ENVIRONMENTAL CONDITIONING SYSTEM AND METHOD FOR CONTROLLING THE CIRCULATION OF NON-CONDITIONED AIR

[75] Inventors: Nir Merry, Mountain View; Robert M. Russ, Los Altos Hills; Larry A. Lincoln, Milpitas; Thomas L. Webster, Piedmont, all of Calif.

[73] Assignee: Gas Research Institute, Chicago, Ill.

[21] Appl. No.: 542,310

[22] Filed: Oct. 12, 1995

[51] Int. Cl.[6] ..... F24F 11/00

[52] U.S. Cl. ..... 454/256; 236/49.3; 454/229

[58] Field of Search ..... 454/229, 236, 454/239, 251, 256, 333; 236/49.3

[56] References Cited

U.S. PATENT DOCUMENTS

| | | | |
|---|---|---|---|
| 3,949,808 | 4/1976 | Gilles | 454/229 X |
| 3,949,809 | 4/1976 | Gilles | 454/229 X |
| 4,406,397 | 9/1983 | Kamata et al. | 236/49.3 X |
| 4,742,475 | 5/1988 | Kaiser et al. | 364/550 |
| 4,754,919 | 7/1988 | Otsuka et al. | 236/49.3 |
| 4,795,088 | 1/1989 | Kobayashi et al. | 236/49.3 |
| 4,811,897 | 3/1989 | Kobayashi et al. | 236/49.3 |
| 4,812,997 | 3/1989 | Okochi et al. | 364/505 |
| 4,828,168 | 5/1989 | Odajima | 236/49.3 |
| 4,884,214 | 11/1989 | Parker et al. | 364/505 |
| 4,897,798 | 1/1990 | Cler | 364/505 |
| 4,969,508 | 11/1990 | Tate et al. | 236/49.3 X |
| 5,076,346 | 12/1991 | Otsuka | 236/49.3 X |
| 5,139,197 | 8/1992 | Seshimo et al. | 236/49.3 |
| 5,148,977 | 9/1992 | Hibino et al. | 236/49.3 |
| 5,153,807 | 10/1992 | Saito et al. | 364/165 |
| 5,161,606 | 11/1992 | Berkeley et al. | 165/1 |
| 5,172,490 | 12/1992 | Tatsumi et al. | 34/54 |
| 5,181,653 | 1/1993 | Foster et al. | 236/49.3 |
| 5,348,078 | 9/1994 | Dushane et al. | 165/22 |
| 5,495,887 | 3/1996 | Kathnelson et al. | 236/49.3 X |

*Primary Examiner*—Harold Joyce
*Attorney, Agent, or Firm*—Dick and Harris

[57] ABSTRACT

An indoor environmental conditioning system and a method for controlling the circulation of non-conditioned air. The system comprises a conditioning source, air distribution source and air distribution conduit. The air may be propelled at at least two different flow rates.

15 Claims, 2 Drawing Sheets

INDOOR ENVIRONMENTAL CONDITIONING SYSTEM AND METHOD FOR CONTROLLING THE CIRCULATION OF NON-CONDITIONED AIR

BACKGROUND OF THE INVENTION

1. Field of the Invention

The present invention is directed to indoor environmental conditioning systems and, more particularly, to an indoor environmental conditioning system and method for controlling the distribution of non-conditioned air to one or more locations or zones.

2. Background Art

Indoor environmental conditioning systems, primarily for controlling the climate in at least one location have been known in the art for many years. Indeed, some of these systems have provided for the circulation of non-conditioned air, to maintain the freshness of the air at a particular location. Such circulation of non-conditioned air is typically activated by operation of an off/on fan switch associated with a remotely located thermostat.

In such prior art systems, manual positioning of the fan switch enables the fan, to, in turn, cause the continuous circulation of conditioned, as well as non-conditioned air. However, the flow rate of such circulation, when the fan switch is adjusted to its "on" position, is substantially constant until the fan switch is manually turned to the off (or "auto") position.

Moreover, none of these systems allow for the circulation of such non-conditioned air to be individually determined for more than one desired location or zone.

The undesirability of single flow rate circulation of non-conditioned air arises, in part, in the context of the heightened awareness of particulates and/or pollutants which typically exist in rooms with limited air flow. In response to such a concern, many indoor environmental conditioning systems rely upon expensive air filtration systems, which may combine conventional fiber filters, with electronic filtration systems. While such systems may be effective in cleaning the air to be circulated, they may do so at the cost of increased expense and complexity, and do not provide for the selective delivery of non-conditioned air, at varied rates to different locations within a single system.

While conventional on/off (single) flow rate fans may provide means to enable circulation of non-conditioned air to, for example, the bedroom of a child, such single flow rate systems, which are typically set on a "high" flow rate setting, can have certain disadvantages. For example, when a prior art fan is turned on for circulation of non-conditioned air, the relatively high flow rate of the circulating air may result in an undesirable draft on the child while the child is sleeping. Additionally, the noise associated with the high fan speed may also be disturbing to those exposed to it. Occasionally, high flow rate circulation may be desirable, such as in the environment of a kitchen, to help remove excessive smoke and/or odors.

Accordingly, it is desirable to provide an indoor environmental control system which has the ability to vary the velocity (and/or volumetric flow rate) of circulation of non-conditioned air, as desired, and on a selective location by location basis.

SUMMARY OF THE INVENTION

The present invention comprises, in part, an indoor environmental conditioning system for regulating the circulation of non-conditioned air to one or more locations.

The indoor environmental conditioning system comprises a conditioning source; an air distribution conduit operatively communicating the conditioning source with the one or more locations; air distribution means operably associated with the air distribution conduit for distribution of air to the one or more locations at independent and selectively variable flow rates; air propulsion means associated with the conditioning source and the air distribution conduit for selectively distributing air to the one or more locations.

The air propulsion means is operably configured for propelling air through the air distribution conduit at at least two possible flow rates. In addition, control means are operably associated with the air propulsion means and the air distribution means for controlling actuation of the air distribution means and the air propulsion means, and for enabling the selective circulation of non-conditioned air by the air propulsion means and the air distribution means to the one or more locations at substantially independent flow rates.

In a preferred embodiment of the invention, the control means further comprises means for selectively actuating the air propulsion means to propel air at one of the at least two flow rates; and means for selectively actuating the air distribution means for independently and variably regulating the flow of air from the air distribution conduit into each of the one or more locations.

The control means further comprises a programmable control apparatus operably associated with the air propulsion means; and a transmitting apparatus remotely positioned from the control apparatus.

The transmitting apparatus preferably comprises a full display thermostat. The air propulsion means comprises a variable speed motor.

The system further comprises means to control a desired duration of time for distribution of the non-conditioned air to the one or more locations being provided with the non-conditioned air. In addition, means to control a desired duration of time for distribution of the non-conditioned air to the one or more locations being provided with the non-conditioned air may be provided.

The air distribution means includes, at least one damper associated with the air distribution conduit, the at least one damper being selectively positionable in at least an open orientation and a closed orientation wherein the closed orientation substantially precludes the passage of air from the distribution means to the at least one of the one or more locations, and the open orientation allowing for the passage of air.

The means for actuating the air distribution means further comprises means for controlling the selection of the orientation of the at least one damper relative to each of the one or more locations for which the distribution of non-conditioned air has been selected.

The orientation selection controlling means includes at least one damper control apparatus operatively associated with each of the at least one dampers and a transmitting apparatus remotely positioned from the at least one damper control apparatus, wherein the transmitting apparatus transmitting a required damper orientation signal to the damper control apparatus.

The present invention also comprises, in part, a method for controlling the distribution of non-conditioned air, in an indoor environmental conditioning system, to one or more locations. The method comprises the steps of:

(a) selecting a desired flow rate of non-conditioned air to be distributed through an air distribution conduit to each of one or more locations;

(b) actuating an air propulsion apparatus to propel air through the air distribution conduit at a flow rate sufficient to deliver air to each of the one or more locations at the respective desired flow rates;

(c) actuating air distribution apparatus associated with the air distribution conduit to regulate the flow of air into each of the one or more locations;

(d) coordinating the actuation of the air propulsion apparatus and the actuation of the air distribution apparatus, in order to assure that each of the one or more locations receives air flow at the respective selected flow rate.

The step of selecting a desired duration of time for distribution of the non-conditioned air to the one or more locations being provided with non- conditioned air.

The step of actuating air distribution apparatus includes the step of selectively sending the non-conditioned air to one or more locations.

The step of selectively sending the non-conditioned air further comprises the step of regulating the flow of air into each of the one or more locations with at least one damper apparatus, associated with the air distribution conduit, at each of the one or more locations.

The step of regulating the flow of air into each of the one or more locations further comprises the steps of selectively positioning each of the damper apparatus in a position relative to the flow of air in the air distribution conduit situated between an open orientation permitting a maximum flow of air into the respective location and a closed orientation permitting no flow of air into the respective location.

The step of selecting a desired duration of time for distribution of the non-conditioned air to the one or more locations being provided with non- conditioned air.

BEST MODE FOR PRACTICING THE INVENTION

Figure 1:
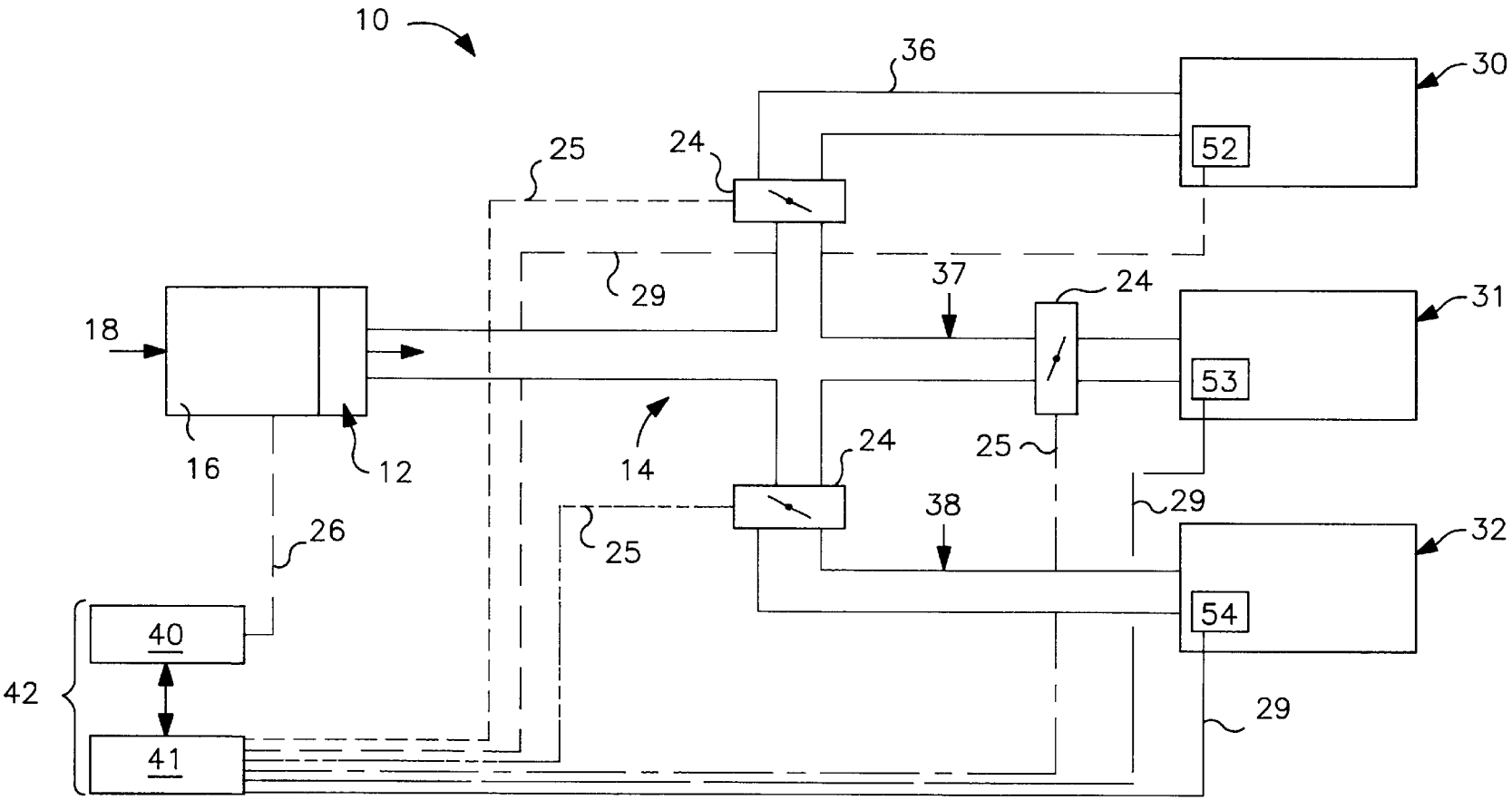
FIG. 1 is a schematic illustration of an indoor environmental conditioning system according to a preferred embodiment of the invention.

While this invention is susceptible of embodiment in many different forms, there is shown in the drawings and will herein be described in detail, one specific embodiment with the understanding that the present disclosure can be considered as an exemplification of the principles of the Invention and is not intended to limit the Invention to the embodiment illustrated.

Indoor environmental conditioning system 10 is shown in FIG. 1 as comprising conditioning source 12, air distribution conduit 14, air propulsion means 16, and control apparatus 42. While conditioning source 12, in a preferred embodiment of the invention may be a heat exchanger in a gas-fired furnace, it is also contemplated that other conventional conditioning sources, such as the cooling coils of an air conditioner, or the heat exchanger tubes of a boiler may be substituted for a gas furnace heat exchanger.

Air 18 is directed into propulsion means 16, for example, from air returns (not shown), the construction and operation of which may be of conventional configuration. Alternatively, air 18 may be supplied from "outside" air intakes (not shown).

Indoor environmental conditioning system 10 regulates the distribution and delivery of non-conditioned air from the air propulsion means to one or more locations, such as locations 30–32, which may be separate rooms in a private residence, for example. Furthermore, as used in this application, the term non-conditioned air will refer to air which has not been intentionally altered in temperature or humidity during passage through a heat exchanger having a relationship with a heat source (combustion) or a cooling source (condenser). Additionally, while indoor environmental conditioning system 10 is discussed herein with respect to a multi-location/multi-zone system, it will be understood to those with ordinary skill in the relevant art, having the present disclosure before them, that the system would be easily applied to a single-location/single-zone system as well.

Air distribution conduit 14, may include conventional HVAC air ducts 36–38, and operably connects conditioning source 12 and each of locations 30–32. Air propulsion means 16 may be, in a preferred embodiment of the invention, a blower, which may be powered by a variable speed motor, such as an electronically commutated motor (ECM).

Selective regulating means 24 are operatively positioned within air distribution conduit 14. Each damper 24 is preferably positionable by a suitable servomotor (not shown, but which may be of otherwise conventional configuration), controlled by a suitable control apparatus (not shown, but which may be of otherwise conventional configuration), which may include a transceiver apparatus connected in two-way communication with control apparatus 42. Each location (or zone) 30–32 preferably has its own respective dedicated damper 24—although other damper configurations are also contemplated. In a preferred embodiment of the invention, dampers 24, upon receipt of appropriate control signals, carried along connections 25 from control apparatus 42, may be adjusted between one or more, and preferably, a number of, different orientations, ranging from a fully closed position wherein air is substantially precluded from passing the respective damper 24 into its corresponding location, to a fully open position wherein a maximum amount of air is allowed to pass. While in a preferred embodiment of the invention, each damper may be selectively positioned into a variety of intermediate positions between fully open and fully closed, the system of the present invention also contemplates simplified systems and simplified operations, in which each damper is positionable in only the described extreme positions.

As previously stated, air propulsion means 16 may be a variable speed blower, capable of at least two speeds, having an electronically commutated motor (ECM), which motor would be provided with the appropriate control circuitry, according to known design principles. Such blower motors and their associated circuitry are commercially available from manufacturers such as White-Rogers Division of Emerson Electric Corporation. In a preferred embodiment, the air propulsion means 16 is configured to force conditioned as well as non-conditioned air through air distribution conduit 14 to the respective locations 30–32, at a flow rate established by propulsion means 16, in response to control signals sent from control apparatus 42 along connection 26.

Control apparatus 42 may include a commercially available microprocessor 40, such as a controller manufactured by Energy Line Systems, which, in a preferred embodiment, is operatively positioned adjacent conditioning source 12 and remote from transmitting apparatus 41.

Figure 2:
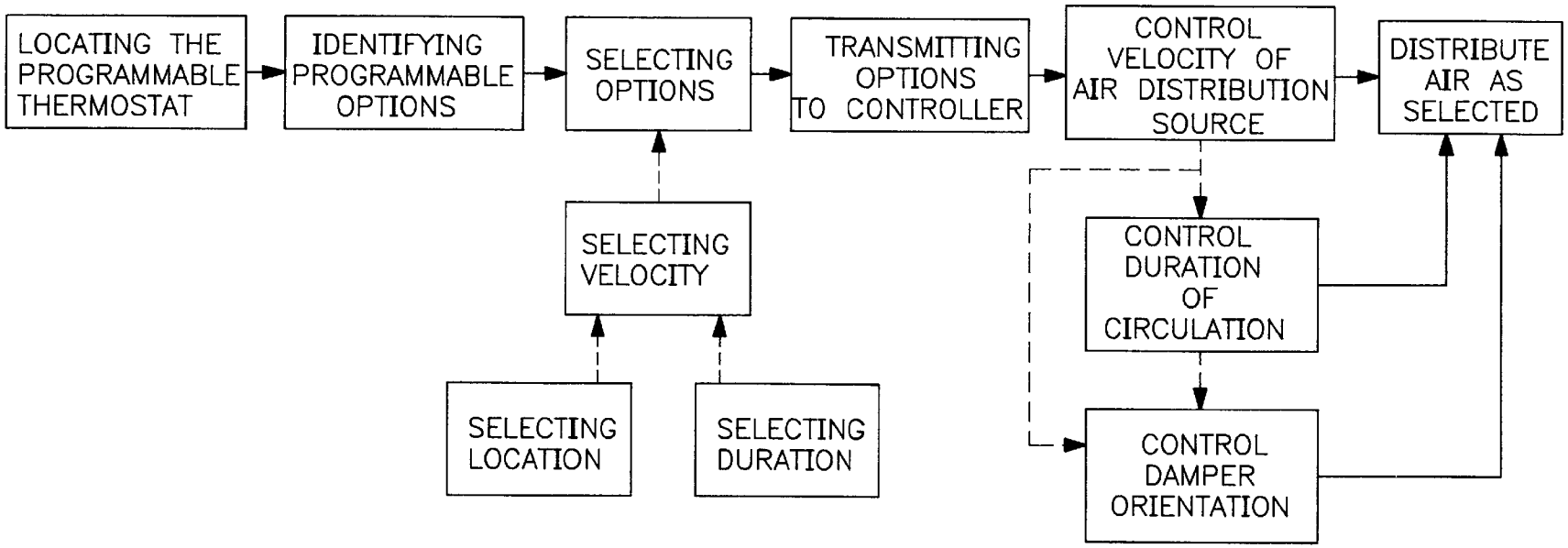
FIG. 2 is a flow chart which forms the basis for programming a control apparatus according to a preferred embodiment of the invention.

However, it will be understood to those with ordinary skill in the art that other locations for mounting of control apparatus 42 are also contemplated. Furthermore, as will be explained with respect to operation of the overall system, and, more particularly, control apparatus 52, and, in turn, the microprocessor, will be programmed, using known programming techniques, in a manner which will enable selective control of the duration of operation and speed of operation of propulsion means 16, and selective actuation of one or more of dampers 24. An example of possible programming choices for control apparatus 52 may be seen in the flow chart of FIG. 2. Processor 40 may also be configured to control the operation of conditioning source 12, as part of the overall heating, air conditioning and ventilation of the collective locations 30–32, among possible others.

Transmitting apparatus 41, which is operably linked to control apparatus processor 40, is contemplated in a preferred embodiment of the invention as comprising a full display thermostat, such as a known in the art. Such a thermostat, which may be linked by any conventional method (eg. wires, radio waves, fiber optic communication, etc.), merely serves as a remote mechanism for transmitting the desired selected non-conditioned air flow rate, location and/or duration control signals from processor 40 to the various components of system 10. While a full display thermostat is shown and described herein as comprising transmitter 41, alternatively, system 10 could be configured without a remote transmitting apparatus, and thus system 10 could be operated by, for example, physical adjustment of control apparatus at the blower motor by, for example, a multi-positionable switch.

It is contemplated that "secondary" transmitting apparatus, such as transmitting apparatus 52–54 may be operably positioned in locations 30–32, respectively, and connected to control apparatus 42 via connections 29. Consequently, the desired circulation of non-conditioned air may be actuated from the main transmitting apparatus 41 or from each location's respective secondary transmitting apparatus 52–54, individually. Secondary transmitting apparatus may be a simple thermostat, with switches for actuating circulation of non-conditioned air, which switches may be graduated for requesting variation of air flow.

Processor 40 preferably will be provided with suitable programming for controlling the orientation of the dampers, for example, by generating appropriate control signals for the operation of servomotors (not shown) which may accomplish the actual movement of dampers 24. The damper control programming may be provided so as to operate the respective dampers in response to signals from transmitting apparatus 52–54, or in response to reprogramming instructions in control apparatus 42. Dampers of the type contemplated for use in a preferred embodiment are commercially available from Johnson Controls in Milwaukee, Wis., for example.

At least one of transmitting apparatus 41 and secondary transmitters 52–54 is a display type thermostat, capable of receiving user-programming, or alternatively, placing a user in communication with processor 40, to enable user programming of processor 40, upon desiring a change in the circulation of non-conditioned air to one or more locations.

The display identifies the program selections which can be chosen by the user. A keypad may be provided, to enable the user to select among several possible options, selecting the desired location and the desired flow rate of circulation. The user may also select a desired duration of circulation—selecting a particular start time and duration for the circulation of non-conditioned air to a selected location.

For example, the user may wish to circulate non-conditioned air in a child's room at a medium flow rate, for two hours in the afternoon. To program this selection into the thermostat, the user identifies the proper location on the display thermostat and selects this location. Next the user identifies the proper flow rate on the thermostat and selects this flow rate. Lastly the user enters into the display thermostat the desired start time and, in turn, the desired stop time. The user can repeat each of the steps to program a desired flow rate and time duration for each desired location of the system.

Each of the selected options are, in turn, transmitted from the display thermostat or transmitter 41 to processor 40. The processor 40 calculates or "looks up" in its memory the proper motor speed, the proper orientation of the dampers contained in the system and the proper duration of time for circulation—according to the selections transmitted by the thermostat 41. The processor 40 instructs the blower circuitry to maintain the desired flow rate in duct portion 15, and instructs the relevant damper servomotors (or other suitable actuators) to assume the calculated (or otherwise determined) respective orientations. The non-conditioned air is then distributed to the desired locations in accord with the options selected by the user.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

We claim:

1. An indoor environmental conditioning system for regulating the circulation of non-conditioned air to at least two locations, the indoor environmental conditioning system comprising:

a source for selectively providing conditioned or non-conditioned air;

an air distribution conduit operatively communicating the source with the at least two locations;

air distribution means operably associated with the air distribution conduit for distribution of air to the at least two locations at independent and selectively variable flow rates;

air propulsion means associated with the source and the air distribution conduit for selectively distributing air to the at least two locations, the air propulsion means being operably configured for propelling air through the air distribution conduit at at least two possible flow rates;

control means, operably associated with the air propulsion means and the air distribution means for controlling actuation of the air distribution means and the air propulsion means, and for enabling the selective circulation of non-conditioned air by the air propulsion means and the air distribution means to the at least two locations at substantially independent flow rates, including means for actuating the air propulsion means and air distribution means to cause the controlled circulation of non-conditioned air substantially without altering the condition of the air in the at least two locations at substantially independent flow rates.

2. The indoor environmental conditioning system according to claim 1, wherein the control means further comprises:

means for selectively actuating the air propulsion means to propel air at one of the at least two flow rates; and means for selectively actuating the air distribution means for independently and variably regulating the flow of air from the air distribution conduit into each of the at least two locations.

3. The apparatus according to claim 1, wherein the control means further comprises:

a programmable control apparatus operably associated with the air propulsion means; and a transmitting apparatus remotely positioned from the programmable control apparatus.

4. The indoor environmental conditioning system according to claim 3, wherein the transmitting apparatus comprises a full display thermostat.

5. The indoor environmental conditioning system according to claim 1, wherein the air propulsion means comprises a variable speed motor.

6. The indoor environmental conditioning system according to claim 1, further comprising means to control a desired duration of time for distribution of the non-conditioned air to the at least two locations being provided with the non-conditioned air.

7. The indoor environmental conditioning system according to claim 2, further comprising means to control a desired duration of time for distribution of the non-conditioned air to the at least two locations being provided with the non-conditioned air.

8. The indoor environmental conditioning system according to claim 2, wherein the air distribution means includes at least one damper associated with the air distribution conduit, the at least one damper being selectively positionable in at least an open orientation and a closed orientation wherein the closed orientation substantially precludes the passage of air from the distribution means to the at least one of the at least two locations, and the open orientation allowing for the passage of air.

9. The indoor environmental conditioning system according to claim 8, wherein the means for actuating the air distribution means further comprises means for controlling the selection of the orientation of the at least one damper relative each of the at least two locations for which the distribution of non-conditioned air has been selected.

10. The indoor environmental conditioning system according to claim 9, wherein the orientation selection controlling means includes at least one damper control apparatus operatively associated with each of the at least one dampers and a transmitting apparatus remotely positioned from the at least one damper control apparatus, wherein the transmitting apparatus transmitting a required damper orientation signal to the damper control apparatus.

11. A method for controlling the distribution of non-conditioned air, in an indoor environmental conditioning system, to at least two locations, the method comprising the steps of:

(a) selecting a desired flow rate of non-conditioned air to be distributed from a source for selectively providing conditioned or non-conditioned air, through an air distribution conduit to each of (one or more at least two locations;

(b) actuating an air propulsion apparatus to propel air through the air distribution conduit at a flow rate sufficient to deliver air to each of the at least two locations at the respective desired flow rates;

(c) actuating air distribution apparatus associated with the air distribution conduit to regulate the flow of air into each of the at least two locations;

(d) coordinating the actuation of the air propulsion apparatus and the actuation of the air distribution apparatus, in order to assure that each of the at least two locations receives air flow at the respective selected flow rate, (e) circulating non-conditioned air, at substantially independent flow rates to the at least two locations, through actuation of the air propulsion means and air distribution means substantially without altering the condition of the air in the at least two locations.

12. The method according to claim 11 further including the step of selecting a desired duration of time for distribution of the non-conditioned air to the at least two locations being provided with non-conditioned air.

13. The method according to claim 11 wherein the step of actuating air distribution apparatus includes the step of selectively sending the non-conditioned air to at least two locations.

14. The method according to claim 13 wherein the step of selectively sending the non-conditioned air further comprises the step of regulating the flow of air into each of the one or more locations with at least one damper apparatus, associated with the air distribution conduit, at each of the at least two locations.

15. The method according to claim 13, wherein the step of regulating the flow of air into each of the at least two locations further comprises the steps of selectively positioning each of the damper apparatus in a position relative to the flow of air in the air distribution conduit situated between an open orientation permitting a maximum flow of air into the respective location and a closed orientation permitting no flow of air into the respective location.

* * * * *

UNITED STATES PATENT AND TRADEMARK OFFICE

CERTIFICATE OF CORRECTION

PATENT NO. :5,772,501

DATED :June 30, 1998

INVENTOR(S) :Merry et al.

It is certified that error appears in the above-identified patent and that said Letters Patent is hereby corrected as shown below:

| | |
|---|---|
| Col. 8, line 8 | Delete "one or more" and insert instead -- at least two --. |
| Col. 8, line 37 | Delete "one or more" and insert instead -- at least two --. |

Signed and Sealed this

Fifteenth Day of September, 1998

Bruce Lehman

*Attest:*

BRUCE LEHMAN

*Attesting Officer*

*Commissioner of Patents and Trademarks*